US007963262B2

(12) United States Patent
Heise

(10) Patent No.: US 7,963,262 B2
(45) Date of Patent: Jun. 21, 2011

(54) RESONATOR ASSEMBLY

(75) Inventor: Volker Heise, Trier (DE)

(73) Assignee: Delphi Technologies, Inc., Troy, MI (US)

( * ) Notice: Subject to any disclaimer, the term of this patent is extended or adjusted under 35 U.S.C. 154(b) by 407 days.

(21) Appl. No.: 12/265,966

(22) Filed: Nov. 6, 2008

(65) Prior Publication Data

US 2009/0120394 A1 May 14, 2009

(30) Foreign Application Priority Data

Nov. 8, 2007 (EP) ..... 07021710

(51) Int. Cl.
*H01T 13/42* (2006.01)
*H01T 13/44* (2006.01)

(52) U.S. Cl. ..... 123/143 B

(58) Field of Classification Search ..... 123/143 B
See application file for complete search history.

(56) References Cited

U.S. PATENT DOCUMENTS 7,080,638 B2 * 7/2006 Mizutani et al. ..... 123/635
7,777,401 B2 * 8/2010 Jaffrezic et al. ..... 313/134
2002/0101315 A1 * 8/2002 Hamer et al. ..... 336/90
2006/0048732 A1 * 3/2006 Schmidt et al. ..... 123/143 B
2009/0165764 A1 * 7/2009 Agneray et al. ..... 123/606

FOREIGN PATENT DOCUMENTS

DE 10 2005 037420 2/2007
DE 10 2006 037246 2/2007
EP 1 662 626 5/2006

OTHER PUBLICATIONS

EP Search Report dated Mar. 28, 2008.

* cited by examiner

*Primary Examiner* — Erick Solis
(74) *Attorney, Agent, or Firm* — Thomas N. Twomey

(57) ABSTRACT

A resonator assembly is described having a longitudinal axis and generator section, an inductance section, a capacitance section, and an ignition section arranged in sections in a common housing along the longitudinal axis. The housing surrounds all the above-mentioned sections and has an opening in the region of the ignition section, and the housing is made of an electrically conductive material or has at least one conductive surface. An electrical series circuit comprising an inductance section and capacitance section constitutes electrically an oscillatable dipole to which the housing acts as a return conductor.

10 Claims, 3 Drawing Sheets

RESONATOR ASSEMBLY

TECHNICAL FIELD

The invention concerns a resonator assembly for generating ignition energy for the combustion of gas mixtures.

BACKGROUND OF THE INVENTION

The invention concerns a resonator assembly for generating ignition energy for the combustion of gas mixtures, which in a manner known in the art as a functional element includes a generator in a generator section, a voltage increase being sought by suitable excitation in an oscillating circuit encompassed thereby, a resonator section mounted functionally behind the generator section and electromagnetically coupled thereto and having a further oscillating circuit which for this purpose includes at least one inductance, and an ignition section.

In the resonator coupled to the generator, a voltage superelevation is to arise during operation, which with the continuous supply of energy from the generator can attain 100 to 200 times the voltage fed to the resonator from the generator, while in the section in front, that is, in the generator, the voltage increase attainable there is usually 2-3 times the operating voltage applied. The oscillating circuits of generator and resonator, that is, the inductances and capacitances encompassed thereby, here function as energy storage devices, previously supplied energy being at least temporarily stored in a magnetic field of the respective inductance and cyclically converted to electrostatic energy in a capacitance assigned to the inductance or associated with the inductance due to component specifics or geometry. In case of resonance superelevation, at outputs of the resonator in particular due to suitable geometrical design of housing or housing elements there is arcing, that is, plasma formation, which in an internal combustion engine is used in a manner known in the art to ignite an air/fuel mixture.

Resonator assemblies of this kind are known in the art, and reference is made to DE 10 2006 037 246 A 1, DE 10 2005 037 420 A1 and EP-A-1 662 626, for example. The resonator assembly functions here as an energy storage device, previously supplied energy being at least temporarily stored in a magnetic field of the resonator assembly and cyclically converted to electrostatic energy of a capacitance associated with the resonator assembly. The resonator assembly includes a generator and a resonator mounted behind the latter, both the generator and the resonator each comprising an oscillating circuit, that is, a capacitance coupled to an inductance. On excitation of the oscillating circuit on the generator side, a voltage increase occurs in the latter in a manner known in the art, attaining e.g. two or three times the operating voltage applied. In the resonator coupled to the generator, on the other hand, a voltage superelevation occurs, which if energy is continuously supplied from the generator can perfectly well attain one hundred to two hundred times the voltage fed to the resonator from the generator.

A drawback of the resonator assemblies known in the state of the art lies above all in that electromagnetic parameters are not known in a manner required for optimum generation of plasma in the region of the spark gap. For example, with the solution according to the above-mentioned DE 10 2005 037 420 there is no spatial limitation of the magnetic field of the resonator assembly there, so that this is influenced by material located in the environment as well. With the resonator assembly described in DE 10 2006 037 246, a disadvantage also lies in that, due to the connection of the generator, a point between the inductance and capacitance of the generator is kept at earth potential, so that in an unfavourable manner the desired resonant frequency is influenced by external magnetic materials because the magnetic field is not spatially limited. Furthermore, there may also be an effect on articles located in spatial proximity to the resonator assembly, e.g. heating. Lastly, known solutions also seem to neglect protection against the high voltage arising, or it is attempted to achieve possible protection by external means, e.g. a cap, a sleeve or the like. In EP-A-1 662 626 only an inductance section and a capacitance section are shielded by a housing or a casing.

SUMMARY OF THE INVENTION

An object of the invention accordingly consists of providing a resonator assembly of the kind mentioned hereinbefore, in which disadvantages as outlined above are avoided or at least reduced with respect to their effects.

This object is achieved according to the invention with the characteristics of claim 1. For this purpose, in a resonator assembly of the kind mentioned hereinbefore, that is, a resonator assembly with generator, inductance and capacitance, it is provided that these elements succeed each other in sections in a common housing along a longitudinal axis of the resonator assembly, so that a generator section, an inductance section, a capacitance section and an ignition section are formed. In this case the housing surrounds all the above-mentioned sections and has an opening in the region of the ignition section, so that plasma which forms can come into contact with the air/fuel mixture. The housing is made of an electrically conductive material or has at least one conductive surface. The electrical series circuit comprising an inductance section and capacitance section constitutes electrically an oscillatable dipole to which the housing acts as a return conductor.

An advantage of the invention lies firstly in the shape that can be achieved by the section-like sequence of generator section, inductance section, capacitance section and ignition section, namely a substantially elongate, cylindrical shape which allows easy introduction into the engine block of an internal combustion engine, the resulting total length of the resonator assembly also being useful so that the opening in the region of the ignition section is located in a section of the combustion chamber of the engine provided for this purpose when the resonator assembly is in the assembled state. The fact that all the above-mentioned sections are arranged in a common housing results in a shield for the electromagnetic fields that arise during operation, preventing surrounding functional units and assemblies from being influenced. But furthermore the functional units of the resonator assembly are themselves protected against any influences from the outside. For this purpose the housing is made of a conductive material or has at least one conductive surface. The need for a separate return conductor is eliminated, as the housing functions as a return conductor to the oscillatable dipole, which is formed by the electrical series circuit comprising inductance and capacitance sections.

Advantageous embodiments of the invention are the subject of the subsidiary claims. Back-references used here indicate further development of the subject of the main claim by the characteristics of the respective subsidiary claim; they are not meant as dispensation with obtaining independent objective protection for the combinations of characteristics of the subsidiary claims to which back-reference is made.

Furthermore, with respect to interpretation of the claims with a more detailed specification of a characteristic in a subsequent claim, it must be assumed that no such restriction exists in the preceding claims.

A mutual influence between the electrically operating components of generator section, inductance section and capacitance section can be avoided or at least reduced if these regions are arranged successively without overlap along the longitudinal axis. This facilitates firstly the mechanical construction of the resonator assembly, e.g. such that each section can be combined in segments with the or each adjacent section, e.g. by bolting, latching or the like, to form the resonator assembly. Secondly, undesirable mutual influences e.g. due to interactions between the resulting electromagnetic fields are reduced, so that the behaviour of the resonator assembly approaches an ideal resonator assembly with corresponding electrical components, and this can be understood with sufficient accuracy by mathematical modelling, which allows optimum control thereof for achieving on the one hand the voltage increase in the generator and on the other hand the voltage superelevation in the resonator.

The capacitance section is preferably designed as a metal cylinder which forms a section of the housing and of which the inner surface acts as an electrode and the outer surface acts as part of the return conductor, so that this section of the housing performs both the mechanical and electromagnetic protective function, the function as capacitance of the oscillating circuit of the resonator and lastly also the function as return conductor for the resonator assembly as a whole. A free end of such a metal cylinder then functions as an ignition section so that, in case of resonance, plasma forms within this free end, in particular directly in the edge region of the free end.

Preferably an inductance encompassed by the inductance section with a plurality of coil turns is oriented in such a way that a magnetic field which forms within the inductance during operation of the resonator assembly is coaxial with the longitudinal axis of the resonator assembly. For this purpose the coil turns are arranged on an (imaginary) cylinder wall all in the same plane. With respect to the design of the resonator assembly, the inductance therefore contributes substantially to its length; a diameter, that is, a width, and a depth of a surrounding enveloping contour remains small compared with the total length, so that the resonator assembly as a whole assumes a tubular contour, which makes it easier to introduce it into the engine block, sections located within the engine block when assembled being protected by the latter in addition. The generator section includes an electronic system which operates to excite the inductance and capacitance sections, connections for their external supply being passed through the housing. The electronic system is also protected electromagnetically and mechanically by the housing, so that when the oscillating circuits encompassed by the resonator assembly are excited, the function of the electronic system is not affected by external magnetic fields which would otherwise have a disturbing influence on these circuits. If the connections for external supply to the electronic system are passed through the housing, an opening in the housing which is necessary for external supply to the electronic system is limited to a minimum.

The functional sections encompassed by the resonator assembly, that is, generator section, inductance section and/or capacitance section, can be connected to each other releasably, in particular by a screw or plug-in connection formed in the housing. Alternatively it may also be provided that individual functional sections or all of them are connected to each other by a one-piece housing or, if two functional sections are combined in a one-piece housing, a corresponding housing section. The first alternative with functional sections releasably connected to each other has the advantage of possible simplification of manufacture, individual functional sections also being capable of being exchanged quickly in case of breakdown. The second alternative with the one-piece housing or a one-piece housing section encompassing at least two functional sections has the advantage that contact points are avoided, so that as a whole the electromagnetic properties of the whole assembly can be theoretically determined better, so that theoretically determined values for whole series of such resonator assemblies can be calculated without individual adjustments to specifically built functional units or resonator assemblies being necessary, or so that such are at least reduced to an unavoidable minimum. Also, possible variation of electrical or electromagnetic properties during operation can be prevented, which may arise e.g. when a screw or plug-in connection comes loose during operation, so that an additional ohmic resistance is formed for the return conductor or the working surface of the electrode of the capacitance section varies and in this respect the resonance properties of the oscillating circuit affected thereby vary, which even in case of minimal variations can lead to the resonator no longer being optimally excited, so that the desired voltage superelevation fails or is lower than planned.

The housing of the resonator assembly is designed for introduction into an engine block of an internal combustion engine. The external shape is accordingly adapted to this application, i.e. the resonator assembly tapers e.g. either continuously or discontinuously as far as the ignition section. With a discontinuous taper, to achieve a capacity for easy introduction into the engine block it is at least provided that the outer surface of the housing in the region of such discontinuous transitions remains at least free from edges, i.e. a transition from a larger diameter to a smaller diameter occurs by a corresponding bevelling. The housing can have guide elements on its outer surface such as e.g. guide webs or the like which are located e.g. only in its region facing away from the ignition section, so that forced adjustment of the resonator assembly takes place by the fact that terminals of the electronic system of the generator section are optimally accessible. In addition, means for fixing the resonator assembly in the engine block can be provided, e.g. after the fashion of a bayonet fastening, such means then acting for forced adjustment and for fixing in the engine block simultaneously.

Preferably the means for fixing in the engine block is or are an integral part of the housing, so that the need to keep separate fixing means available is eliminated and so not only is the number of parts reduced, but also the assembly capacity is optimised.

Below, a practical example of the invention is described in more detail with the aid of the drawings. Subjects or elements corresponding to each other are given the same reference numbers in all figures.

The or each practical example is not meant as a restriction of the invention. Instead, numerous modifications and variations are possible within the scope of the present disclosure, in particular those variants, elements and combinations which the expert can infer for example by combining or modifying individual characteristics or elements or steps of the method described in the general or special part of the specification and contained in the claims and/or drawings with a view to achieving the object, and due to characteristics that can be combined lead to a new subject or new steps of a method or sequences of steps.

BRIEF DESCRIPTION OF THE DRAWINGS

They show.

DESCRIPTION OF THE PREFERRED EMBODIMENTS

Figure 1:
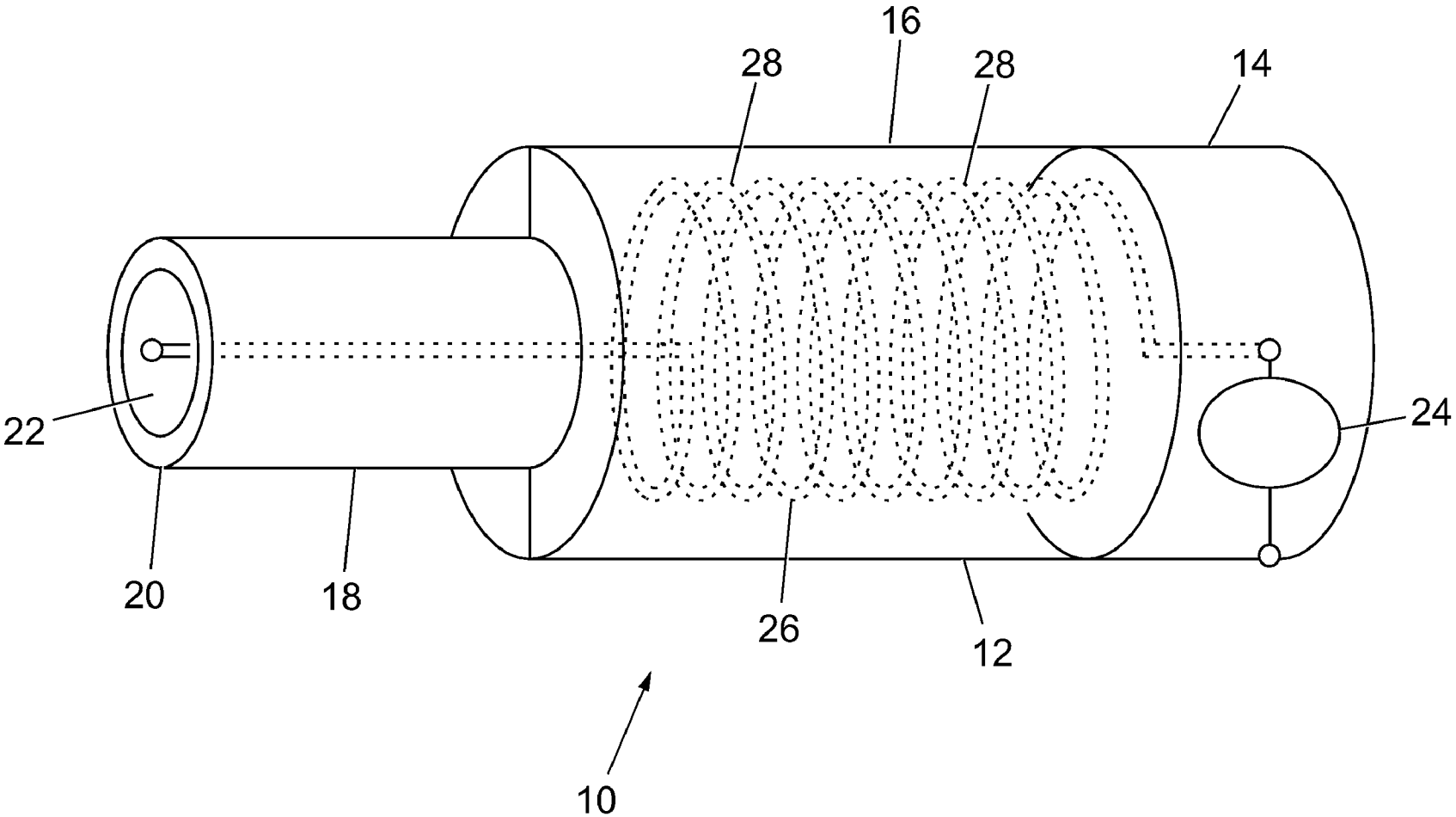
FIG. 1 a resonator assembly.

FIG. 1 shows a schematically simplified resonator assembly according to the invention, marked 10 as a whole. This includes, in a common housing 12, functional sections arranged in section-like fashion along a longitudinal axis, namely a generator section 14, an inductance section 16, a capacitance section 18 and an ignition section 20. The housing 12 surrounds all the above-mentioned functional sections and has an opening 22 in the region of the ignition section 20. The housing 12 is made of a conductive material or has at least one conductive surface.

The generator section 14 includes in a manner known in the art an electronic system 24, shown only schematically, which operates to excite the inductance section 16 and the capacitance section 18 and generates a voltage superelevation therein during operation. For this purpose the electronic system 24 includes its own oscillating circuit which is electromagnetically coupled to the inductance section 16, the oscillating circuit of the electronic system 24 and the oscillating circuit composed of the electrically operating components including inductance section 16 and capacitance section 18 being coordinated with each other in such a way that a voltage increase which arises in the generator oscillating circuit in case of resonance is fed to the subsequent oscillating circuit and there in case of resonance leads to a deliberate voltage superelevation and ultimately to generation of a plasma in the region of the ignition section 20.

The inductance section 16 includes an inductance 26 having a plurality of coil turns 28 which are arranged on an (imaginary) cylinder wall all in the same plane, the inductance 26 being oriented in such a way that a magnetic field which forms within the inductance 26 during operation of the resonator assembly 10 is coaxial with the longitudinal axis of the resonator assembly 10. An electrical series circuit comprising inductance section 16, that is, the inductance 26 encompassed thereby, and capacitance section 18 forms an oscillatable dipole, the above-mentioned "second" oscillating circuit to which the housing 12 functions as a return conductor.

In the schematically simplified view in FIG. 1 it can be seen that the generator section 14, the inductance section 16, the capacitance section 18 and the ignition section 20 are arranged successively without overlap along the longitudinal axis of the resonator assembly 10. The capacitance section 18 is here designed as a metal cylinder which forms a section of the housing 12 and of which the inner surface acts as an electrode of the capacitance provided for the capacitance section 18 and of which the outer surface acts as part of the return conductor. Within the metal cylinder forming the capacitance section 18 is passed a conductor which with its free end extends into the ignition section 22 and which in the region of the metal cylinder forms the other electrode of the capacitance.

Figure 2:
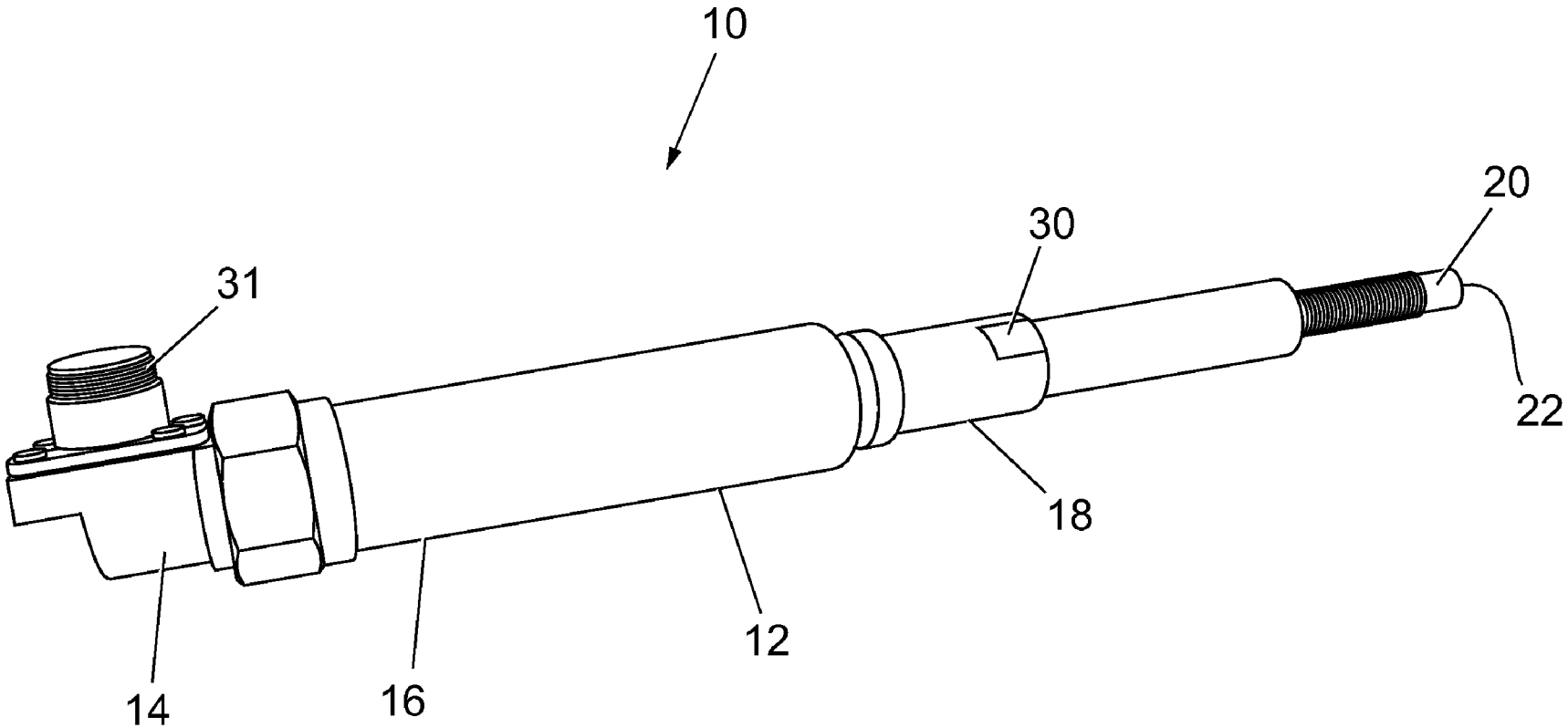
FIG. 2 an embodiment of the resonator assembly in a perspective view.

FIG. 2 shows an embodiment of the resonator assembly 10 in a perspective view. In the diagram are shown, seen from left to right, first the generator section 14, then the inductance section 16 and following this the capacitance section 18, which ends in an ignition section 20 and in an opening 22 not visible in the diagram of FIG. 2.

The diagram in FIG. 2 shows that the resonator assembly tapers from the generator section 14 to the ignition section 20, so that the resonator assembly can be introduced into an opening 22 provided for this purpose in an internal combustion engine (both not shown). The resonator assembly 10 can have on the outside of the housing 12 surrounding all functional sections 14-20, for adjustment thereof when installed, working surfaces 30, stop means or the like which, in cooperation with a corresponding companion contour in the bore in the engine, prevent the resonator assembly 10 from turning and/or cause forced orientation.

In the region of the generator section is shown a screw joint 31 through which can be passed connections for external supply to the electronic system 24 (cf. FIG. 1).

Figure 3:
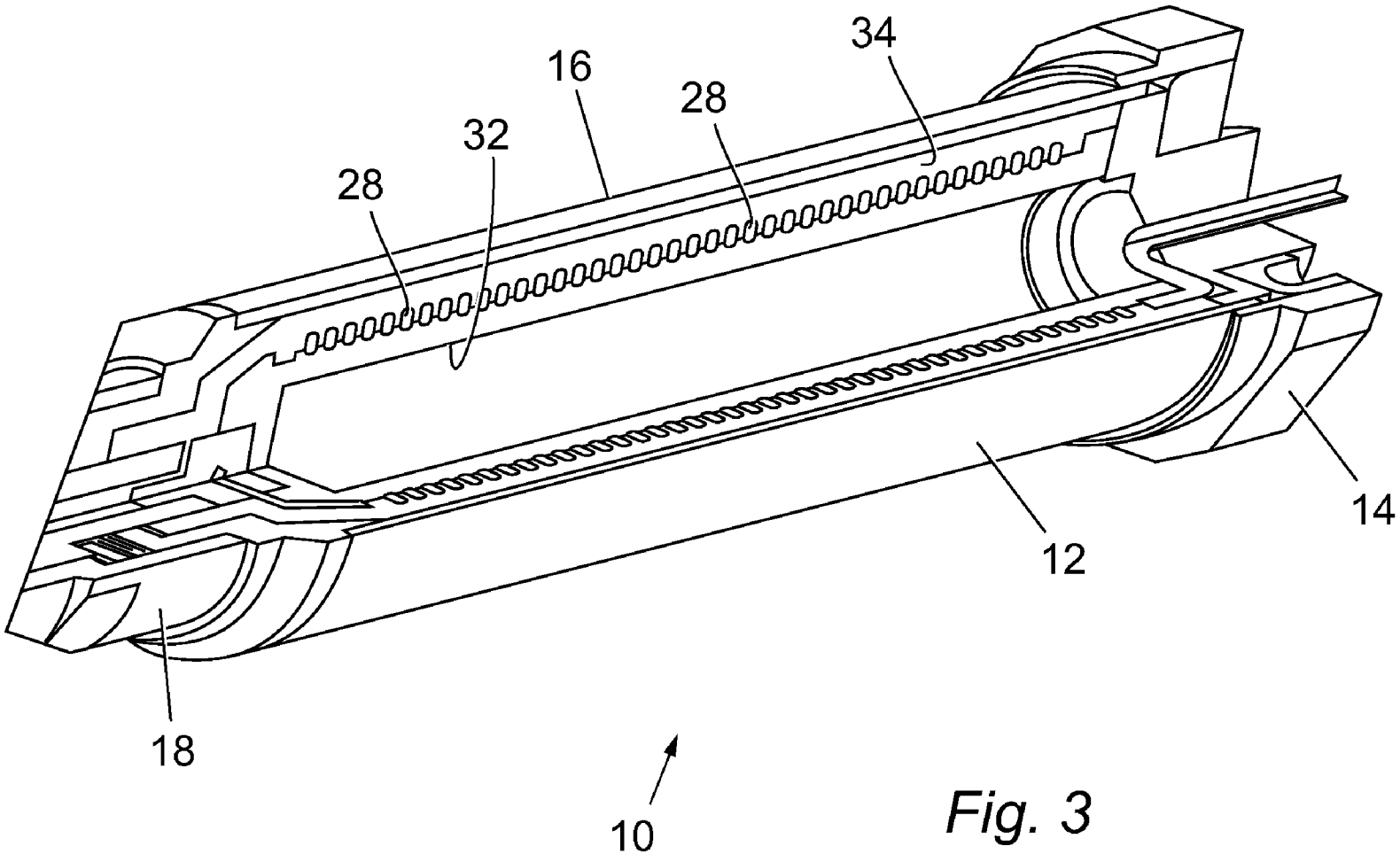
FIG. 3 a resonator assembly in a partly sectioned view.

FIG. 3 shows the resonator assembly as in FIG. 1 or FIG. 2 in a partly sectioned view in which in the region of the inductance section 16 it can be seen that the coil turns 28 encompassed by the inductance 26 located there are arranged on an (imaginary) cylinder wall all in the same plane, a hollow core 32 which carries the coil turns 28 being provided for this purpose in the embodiment shown in FIG. 3. Adjoining the core 32 and the coil turns 28 surrounding it is an insulator 34 which has an outside diameter coordinated with the inside diameter of the housing 12 in the inductance section 16. Such form-locking coordination of insulator 28 and inside diameter of the housing section 12 concerned can result from the fact that the core 32 with the coil turns 28 mounted thereon is fixed in the housing 12 with a hardening sealing medium acting as the insulator 34.

In FIG. 3 lastly can be seen (in the top right corner of the diagram) part of the generator section 14, while at the opposite end of the inductance section 16 can also be seen part of the capacitance section 18. Whereas basically a one-piece housing 12 which includes generator section 14, inductance section 16 and/or capacitance section 18 is provided for the resonator assembly 10, in the diagram in FIG. 3 it is shown that the housing 12 is in one piece only in sections and at the transition from one functional element to an adjacent functional element a corresponding housing section is connected to the adjacent housing section. The connection may be releasable or non-releasable. Welded or soldered joints are possible as the non-releasable connection. Screw or plug-in connections, e.g. a plug-in connection on the principle of a bayonet fastening, are possible as the releasable connections.

To sum up, the present invention can therefore be presented briefly as follows. A resonator assembly 10 with a longitudinal axis and, arranged in sections in a common housing 12 along the longitudinal axis, functional sections 14-20 is provided, the housing 12 surrounding all the above-mentioned functional sections 14-20 and having an opening 22 in the region of one of the functional sections, the ignition section 20, the housing 12 being made of a conductive material or having at least one conductive surface, and an electrical series circuits comprising inductance section 16 and capacitance section 18 electrically forming an oscillatable dipole to which the housing 12 functions as a return conductor, so that the electromagnetically operating elements and functional units encompassed by the resonator assembly 10 are protected against electromagnetic fields from the outside, and electromagnetic fields arising during operation of the resonator assembly 10 do not adversely affect units or functional elements positioned adjacent to the resonator assembly 10.

This invention has been described in detail with respect to the embodiments disclosed herein, but it should be understood that modifications and variations may be made within the scope and spirit of the invention.

The invention claimed is:

1. Resonator assembly having a longitudinal axis and generator section, inductance section, capacitance section and ignition section arranged in sections in a common housing along the longitudinal axis, wherein the housing surrounds all the above-mentioned sections and has an opening in the region of the ignition section, wherein the housing is made of an electrically conductive material or has at least one conductive surface, and wherein an electrical series circuit comprising an inductance section and a capacitance section constitutes electrically an oscillatable dipole to which the housing acts as a return conductor.

2. Resonator assembly according to claim 1, wherein the generator section, the inductance section, the capacitance section and the ignition section are arranged successively without overlap along the longitudinal axis.

3. Resonator assembly according to claim 2, wherein the capacitance section is designed as a metal cylinder which forms a section of the housing and of which the inner surface acts as a capacitance and the outer surface as part of the return conductor.

4. Resonator assembly according to claim 3, wherein a free end of the metal cylinder functions as an ignition section.

5. Resonator assembly according to claim 1, wherein the inductance section encompasses an inductance with a plurality of coil turns which are arranged on a cylinder wall all in the same plane, the inductance being oriented in such a way that a magnetic field which forms within the inductance during operation of the resonator assembly is coaxial with the longitudinal axis of the resonator assembly.

6. Resonator assembly according to claim 1, wherein the generator section includes an electronic system which operates to excite the inductance and capacitance sections, connections for external supply thereto being passed through the housing.

7. Resonator assembly according to claim 1, wherein generator section and inductance section, in particular generator section, inductance section and capacitance section, are connected to each other releasably, in particular by a screw or plug-in connection formed in the housing.

8. Resonator assembly according to claim 1, wherein generator section and inductance section, in particular generator section, inductance section and capacitance section, are connected to each other by a one-piece housing section.

9. Resonator assembly according to claim 7, wherein the housing is designed for introduction into an engine block of an internal combustion engine and includes means for fixing in the engine block.

10. Resonator assembly according to claim 9, wherein the means for fixing in the engine block is or are an integral part of the housing.

* * * * *